United States Patent [19]

Kalert et al.

[11] 4,022,179

[45] May 10, 1977

[54] VACUUM CONTROLLED THROTTLE POSITIONER AND DASHPOT

[75] Inventors: Ralph E. Kalert, Granite City, Ill.; Robert E. Schlage, St. Charles, Mo.

[73] Assignee: ACF Industries, Incorporated, New York, N.Y.

[22] Filed: Dec. 29, 1975

[21] Appl. No.: 644,612

[52] U.S. Cl. ..... 123/198 D; 123/DIG. 11; 123/97 R; 251/55; 261/DIG. 18

[51] Int. Cl.[2] ..... F02B 77/00

[58] Field of Search ..... 123/DIG. 11, 103 E, 123/198 D, 198 DB, 97 R, 97 B, 179 B, 179 BG, 179 G; 251/48, 55; 261/DIG. 18

[56] References Cited

UNITED STATES PATENTS

| | | | |
|---|---|---|---|
| 2,782,025 | 2/1957 | Olson | 251/48 X |
| 3,618,582 | 11/1971 | Gerutz | 123/DIG. 11 X |
| 3,752,141 | 8/1973 | Charron et al. | 123/DIG. 11 X |
| 3,752,450 | 8/1973 | Charron et al. | 123/DIG. 11 X |
| 3,760,785 | 9/1973 | Harrison et al. | 123/DIG. 11 X |
| 3,805,760 | 4/1974 | Yagi et al. | 123/198 DB |
| 3,881,685 | 5/1975 | Hase et al. | 251/48 |

*Primary Examiner*—C. J. Husar
*Assistant Examiner*—Ira S. Lazarus

[57] ABSTRACT

An integral device for controlling the rate of throttle closure and for preventing after run of an internal combustion engine is provided which utilizes a pair of diaphragm assemblies for accomplishing both functional operations. The device includes a dash pot stem having an axial opening through it. The opening is operatively connected to a source of engine vacuum. A diaphragm housing defining a chamber has a pair of diaphragm assemblies positioned in it. A first diaphragm assembly is mounted to the dash pot stem. The second diaphragm assembly is movably mounted on the dash pot stem and includes a shaft extending through the housing. The shaft is engagable with suitable linkage means operatively connected to a throttle valve of a carburetor for the engine. Upon engine start, the application of engine vacuum to a first side of the first diaphragm operates on the diaphragm and housing so that, in effect, the housing moves in a first direction, positioning the shaft at its curb idle position. The second diaphragm assembly extends the shaft as the engine begins to increase speed from curb idle, and acts to bring the carburetor slowly to its curb idle setting upon throttle release from the running condition. Removal of engine vacuum enables the first diaphragm to operate in conjunction with the housing to return the housing to its initial position, permitting the throttle to close below its curb idle setting.

16 Claims, 4 Drawing Figures

VACUUM CONTROLLED THROTTLE POSITIONER AND DASHPOT

BACKGROUND OF THE INVENTION

This invention relates to carburetor control devices, and in particular is intended to be used in conjunction with a carburetor for an internal combustion engine to provide the dual functions of controlling the throttle closure rate after removal of an operator input command so that the carburetor throttle slowly returns to a curb idle setting, and for permitting the throttle to close to a setting below its curb idle setting upon de-energization of the internal combustion engine.

The prior art reveals a number of devices which function to slow throttle movement during the transistion from a run condition to a curb idle condition of an internal combustion engine. These devices are known in the art, and are defined for the purposes of this specification, as a "dash pot". In general, dash pot devices in the prior art are diaphragm activated valve assemblies which include a shaft extending outwardly from a diaphragm valve housing. The diaphragm valve is arranged so that it is capable of reciprocal movement between first and second positions. In a first direction of movement, the action of the diaphragm valve offers increased resistance to shaft movement, so that the shaft moves between the first and second positions slowly. In internal combustion engines, this action is applied to the throttle of the carburetor so that removal of an operator input command, for example, by removing pressure on the acceleration pedal of a conventional passenger vehicle, causes some linkage for controlling throttle movement to bear against the dash pot shaft. The diaphragm valve of the dash pot offers resistance to shaft movement so that the throttle returns to its curb idle position at a controlled rate. A controlled return to the curb idle setting is important in meeting emission standards for exhaust gases of the internal combustion engine. A spring commonly is provided on one side of the diaphragm which is compressed at the curb idle position. The spring returns the diaphragm and its associated shaft to their initial position upon a command for increased acceleration. The shaft is then able to re-engage the throttle or throttle linkage upon removal of the succeeding operator command.

The prior art also reveals various devices which set the curb idle position of the carburetor. Commonly, these devices include a solenoid energized by the vehicle ignition system so that a second shaft is positioned to engage a suitable throttle linkage at the curb idle positon of the carburetor. Upon de-energization of the solenoid, the second shaft retracts so that the throttle is permitted to move to a position below the curb idle setting. Internal combustion engines finding application in present-day passenger vehicles, for example, tend to operate at higher curb idle speeds than older models of those vehicles. When the ignition system is de-energized at the high r.p.m. curb idle speeds, the internal combustion engine has a tendency to continue to draw air and fuel through the carburetor so that the engine exhibits what is known in the art and for the purposes of this specification, as "after run", in that the engine continues to operate in a manner similar to a diesel engine. Use of solenoid operated devices to permit throttle closure below the curb idle position prevents the occurrence of the after run condition.

Integral devices for accomplishing both of these functions also are known in the art. An integral solenoid dash pot device is shown and described in the co-pending United States application to Robert E. Schlage, Ser. No. 611,823, filed Sept. 9, 1975, and assigned to the assignee of the present invention. Integral devices are more advantageous than separate devices common in the art in that separate devices require the use of valuable space in the engine compartment, when space is at a premium in that particular area. Diaphragm actuated integral devices have lower manufacturing costs than solenoid-diaphragm combinations and are desirable for that economic advantage.

The invention described hereinafter provides the dual function of controlled throttle release and after run prevention by providing a single unit for accomplishing these functions. Both functions are accomplished with diaphragm assemblies, which enables the device to have a low unit cost.

One of the objects of this invention is to provide a simplified structure for providing controlled throttle release and preventing engine after run.

Another object of this invention is to provide an integrally constructed unit providing the dual functions of throttle control and after run prevention.

Yet another object of this invention is to provide a unitary device for providing controlled throttle release and preventing engine after run which permits easy adjustment of the curb idle position of an internal combustion engine.

Another object of this invention is to provide a unitary device for preventing after run of an internal combustion engine and controlled throttle release which utilizes flexible diaphragm assemblies for accomplishing a dual function result.

Other objects of this invention will be apparent to those skilled in the art in light of the following description and accompanying drawings.

SUMMARY OF THE INVENTION

In accordance with this invention, generally stated, a carburetor control unit in the form of a vacuum controlled throttle positioner and dash pot is provided which controls the rate of throttle closure and prevents after run of internal combustion engines. A dash pot stem is fixed at a convenient location adjacent the carburetor of an internal combustion engine. The dash pot stem has an axial opening in it which is connected to a source of engine vacuum. A diaphragm housing is movably mounted on the dash pot stem. The housing defines a chamber which contains a pair of diaphragm assemblies including a pair of flexible diaphragms. The diaphragms divide the chamber into three chamber parts. The first diaphragm assembly is attached to the dash pot stem and is positioned so that one chamber part along one side of the diaphragm is operatively connected to a source of engine vacuum through a radial opening in the valve stem which in turn communicates with the axial opening in the valve stem. The second diaphragm assembly includes a shaft having a receptacle formed in it. The receptacle is adapted to receive and move along an end of the dash pot stem. The shaft is operatively connected to the throttle of the carburetor through suitable linkage means. The second diaphragm assembly performs the rate of throttle closure function while the first diaphragm assembly functions to control axial movement between first and second positions of both the housing and shaft of the second diaphragm assembly. The first position sets the curb idle condition of the throttle while the second position enables the throttle to close below the curb idle setting to prevent after run of the engine.

DESCRIPTION OF THE PREFERRED EMBODIMENT

Figure 1:
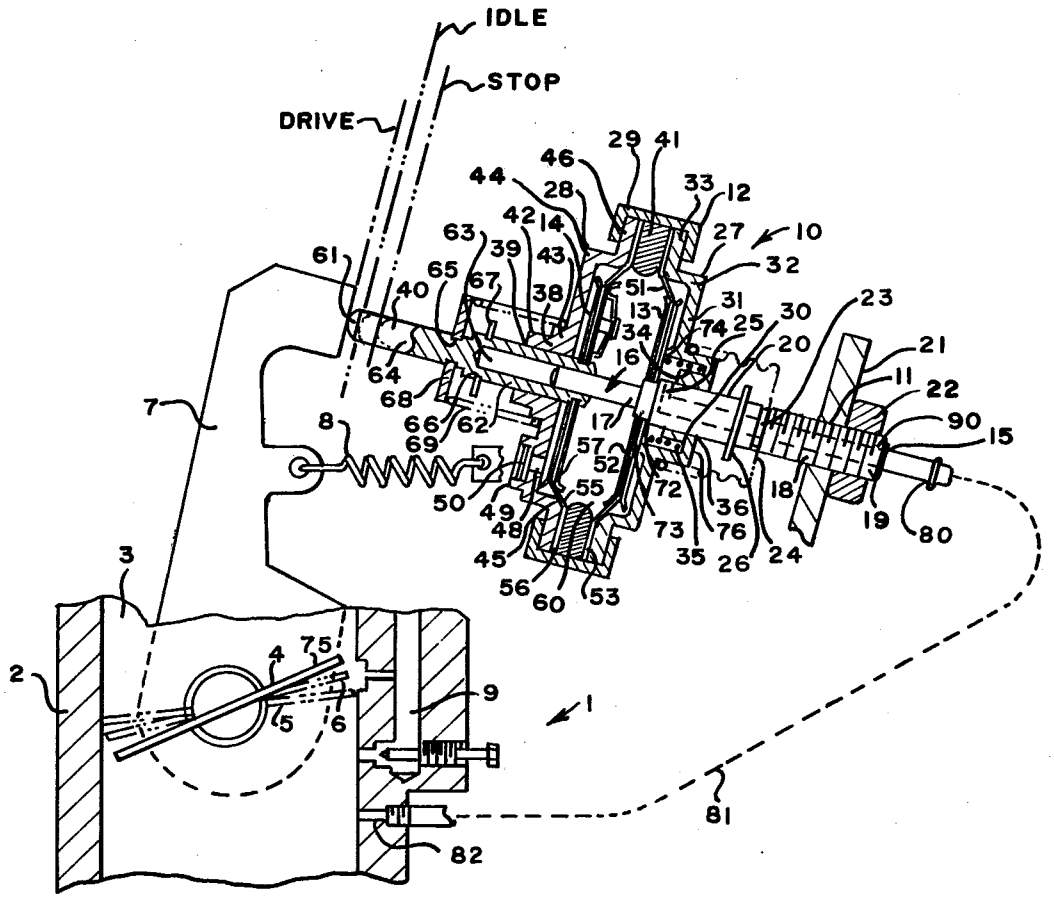
FIG. 1 is a view in side elevation, partly in section and partly broken away, illustrating the application of one illustrative embodiment of control device of this invention.

Referring now to FIG. 1, reference numeral 1 indicates a carburetor for an internal combustion engine, not shown. The carburetor 1 is conventional and generally includes a housing 2 having an air induction passageway 3 through it. The passageway 3 is adapted to receive air along one end, and is connected to the internal combustion engine along its second end.

A throttle valve 4 is pivotally mounted within the air passageway 3 and is movable between a closed position 5, indicated in phantom lines, an idle position 6, indicated in phantom lines, and a run position 75, shown in the full line position of the throttle 4.

A linkage 7 is operatively connected to the throttle 4 and is biased by a sutable device, indicated generally by the spring 8 in FIG. 1, toward the closed position 5 of the throttle 4. The carburetor 1 also includes a main fuel supply circut, not shown, and an idle fuel supply circuit 9. The carburetor 1 structure described is conventional and forms no part of this invention. As indicated above, the higher speeds utilized at the idle setting often would permit the engine to draw fuel and air from fuel circuits supplying the carburetor 1 after engine turn-off so that the engine would continue to run, which condition is known in the art as after run or dieseling. In order to prevent the occurrence of after run, the throttle 4 is permitted to close below the idle position 6 to the off position 5. Likewise, the removal of throttle command so that the throttle 4 is permitted to move from some running position to the idle position 6 quickly has adverse affects on automobile exhaust emission. Consequently, the movement from a run position to the idle position 4 is controlled so that it occurs at some predetermined rate.

Accomplishment, in our invention, of the dual functions described above is achieved by a control device 10. The device 10 includes a dash pot stem 11, a diaphragm housing 12 and a pair of diaphragm assemblies 13 and 14, respectively.

The dash pot stem 11 is an elongated structure having a first end 15 and a second end 16. The end 16, in the embodiment illustrated, has a reduced diameter along a portion 17 of the dash pot stem 11, the diameter of a portion 18 being enlarged with respct thereto. The portion 18 of the stem 11 has an axial opening 19 in it, which opens through the end 15. A connector 80 is attached to the end 15 and permits the attachment of a connection line 81 to the stem 11. The connection line 81 is operatively attached to a source of engine vacuum, as for example, at 82, for purposes described hereinafter. The connector 80 and line 81 are conventional, and any of a variety of commercially available devices may be used.

The portion 18 of the dash pot stem 11 includes an outer wall 20 which is threaded as indicated at 90 to permit attachment and axial adjustment of the dash pot stem 11 with respect to a bracket 21 and a lock nut 22. That is, bracket 21 is attached to the internal combustion engine or the carburetor structure in a location convenient for interaction of the device 10 with the linkage 7. The threads 90 permit interconnection and movement of the dash pot stem 11 while the lock nut 22 functions to hold the position chosen for valve stem location for purposes described in greater detail hereinafter.

The wall 20 also has a groove 23 in it, which receives an end of a flexible dust cover 24. Dust cover 24 is conventional and may be constructed from a variety of suitable materials. It is attached to the device 10 between the housing 12 and the dash pot stem 11.

The portion 18 of the dash pot stem 11 also has at least one radial opening 25 extending through the wall 20. The opening 25 communicates with a chamber 60 defined by the housing 12 on one end and with the axial opening 19 in the dash pot stem 11 on a second end. A stop 26 is attached to and mounted over the portion 18 of the dash pot stem 11. Stop 26 may comprise any convenient structure. A disc type washer of suitable material works well, for example.

The portion 17 of the dash pot stem 11 preferably is a solid cylindrical structure, the junction of the portions 17 and 18 defining a shoulder 72. Shoulder 72 abuts a central hub 73 of the diaphragm assembly 13, as later described.

The diaphragm housing 12 includes a first section 27 and a second section 28 joined to one another along a connector portion 29.

The section 27 generally is annular in plan, having a central hub 30, a surface 31 extending outwardly from the hub 30, an axially extending side 32, and a radially extending lip 33. Hub 30 has a central opening 36 in its which is sized to receive the portion 18 of the dash pot stem 11 in a slip fit. The hub 30 has an annular inner edge 74 which defines a stop for the housing 12 with respect to the diaphragm assembly 13 in one direction of housing movement, and an annular outer edge 76 which cooperates with the stop 26 to limit axial movement of the housing 12 in a second direction of housing movement. Hub 30 also defines a recess 34 on the chamber 60 side of the section 27. Recess 34 receives and seats one end of a spring 35.

The section 28 also includes a central hub 38 having an axial opening 39 through it. The opening 39 is sized to receive and pass a shaft 40 of the diaphragm assembly 14. Hub 38 has a first enlarged diameter portion defining a stop 42, and a second diameter portion defining a spring seat 43. The section 27 generally is annular in plan, and includes a surface 44 extending outwardly from the hub 38, an axially extending side 45, and a radially extending lip 46.

The connection portion 29 is utilized to join the sections 27 and 28 to one another. Interconnection may be accomplished in any convenient way, and a conventional crimping operation works well, for example. The connection portion 29 includes an annular support ledge 41, the purpose of which is described hereinafter.

The surface 44 has an opening 48 through it, which communicates with the chamber 60 defined by the sections 27 and 28 of the housing 12. The opening 48 preferably is positioned centrally of an annular boss 49, the boss 49 being utilized to attach a filter element 50 to the housing 2. The filter element 50 and dust cover 24 prevent foreign material from entering the chamber 60.

Diaphragm assembly 13 is conventional and includes a flexible diaphragm 51 interleafed between a pair of plates 52. The diaphragm 51 has a peripheral edge 53 which is engaged between the lip 33 of the section 27 and the support ledge 41 of the connector portion 29. The plates 52 and diaphragm 51 have a central opening in them, which receives the hub 73. Hub 73 is mounted on the portion 17 of the dash pot stem 11 in a tight, press fit. As indicated, the hub 73 abuts the shoulder 72, while the spring 35 is biased between the recess 34 and one of the plates 52 of the diaphragm assembly 13.

The diaphragm assembly 14 also is conventional and includes a flexible diaphragm 55 interleafed between a pair of plates 57. The diaphragm 55 has a peripheral edge 56 which is engaged between the lip 46 of the section 28 and the support ledge 41 of the connector portion 29. At least one of the plates 57 has an annular rim 58 formed in it, which is intended to abut the surface 44 of the section 28, thereby defining a positive stop for diaphragm assembly 14. The plates 57 and diaphragm 55 have suitable leakage means 59 associated with them. The leakage means 59 is conventional and is not described in detail. In general, it is designed to permit controlled pressure equalization between opposite sides of the diaphragm 55. The plates 57 and diaphragm 55 have a central opening in them, which receives the shaft 40 in a conventional manner.

The shaft 40 has a first end 61 which is intended to abut the linkage 7 in at least one position of the control device 10. A second end 62 of the shaft 40 has a receptacle 63 formed in it, which is sized to receive the end 16 of the dash pot stem 11 in a loose, slip fit. The reception of the stem 11 in the receptacle 63 maintains alignment of the various parts of the device 10 and in particular prevents tipping or twisting of the diaphragm assembly 14. The shaft 40 includes an outer wall 64 having both an annular groove 65 and a circumferential channel 66 formed in it. The channel 66 is intended to receive a stop 67 in a conventional manner, while the groove 65 permits the attachment of a spring seat 68 to the shaft 40. Spring seat 68 also is conventional and may comprise an annular disc of sutable material. A spring 69 is mounted between the spring seat 68 and the spring seat 43 so as to bias the shaft 40, and consequently, the diaphragm assembly 14, leftwardly, leftwardly being referenced to the drawings. A sutable dust cover, not shown, may be placed about the shaft 40 at its exit point from the housing 12, if desired.

Figure 2:
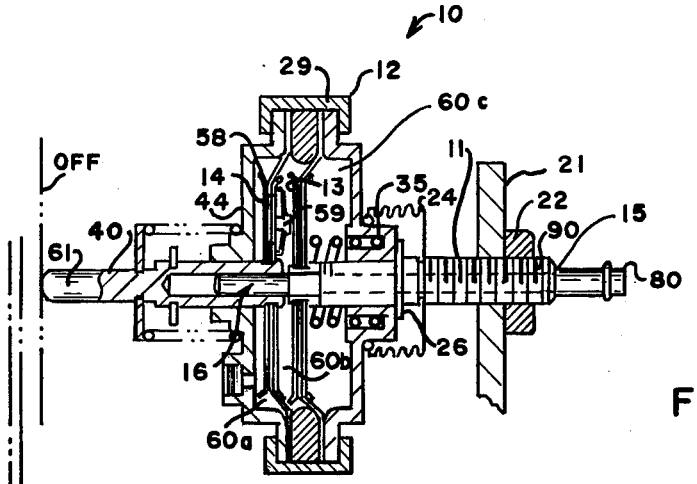
FIG. 2 is a sectional view in side elevation, partly broken away, illustrating the embodiment of FIG. 1 of this invention in the off condition of an associated internal combustion engine.
Figure 4:
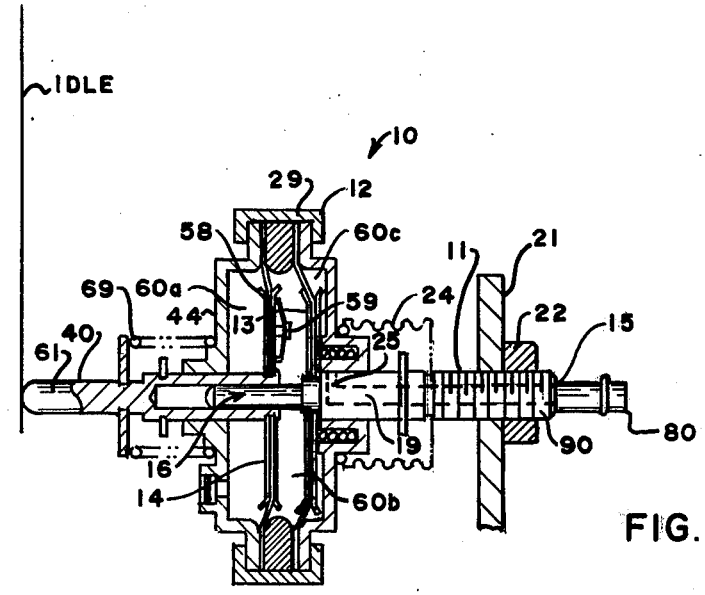
FIG. 4 is a sectional view in side elevation, partly broken away, showing the device of FIG. 1 in its idle position.

The diaphragms 51 and 55 divide the chamber 60 into three chamber parts 60*a*, 60*b* and 60*c*, respectively. The dash pot stem 11 is connected to a source of engine vacuum at 82 and maintains the chamber part 60*c* at engine vacuum during engine operation through the communicative path defined by the axial opening 19 and the radial opening 25 in the dash pot stem. The slip fit between the diaphragm housing 12 and the dash pot stem 11 generally is sufficient to form a communicative path between the opening 25 and the chamber part 60*c*, regardless of the housing 12 position on the stem 11. However, a groove or score line, not shown, may be placed in the stem 11 or hub 30, for example, to ensure communication, if desired. The device 10 is intended to be mounted in any suitable location by the bracket 21, lock nut 22 combination. Consequently, the dash pot stem 11 is fixed with respect to the carburetor, and in particular, with respect to the linkage 7. Since the diaphragm assembly 13 is attached to the dash pot stem 11, it, too, is fixed and the other components of the device 10 move in relationship to the valve stem 11-diaphragm 13 combination. The engine off position is shown in FIG. 2. In that position, the diaphragm assemblies 13 and 14 are located in the left-hand side of the chamber 60. That is to say, the housing 12 has moved rightwardly against the stop 26. Upon engine start, vacuum is applied via the line 81 to the chamber portion 60*c*. The pressure drop in the chamber portion 60*c*, together with the pressure in the chamber portion 60*b*, overcomes the bias of the spring 35. Since the housing 12 is movable on the dash pot stem 11, the housing moves leftwardly so that the diaphragm assemblies 13 and 14 assume the positions shown in FIG. 4. Movement of the housing 12 causes the end 61 of the shaft 40 to move leftwardly, engaging the linkage 7 and delimiting the curb idle position for the carburetor 1. Those skilled in the art will recognize that the curb idle setting can be adjusted easily by moving the dash pot stem 11 along the threads 90.

Figure 3:
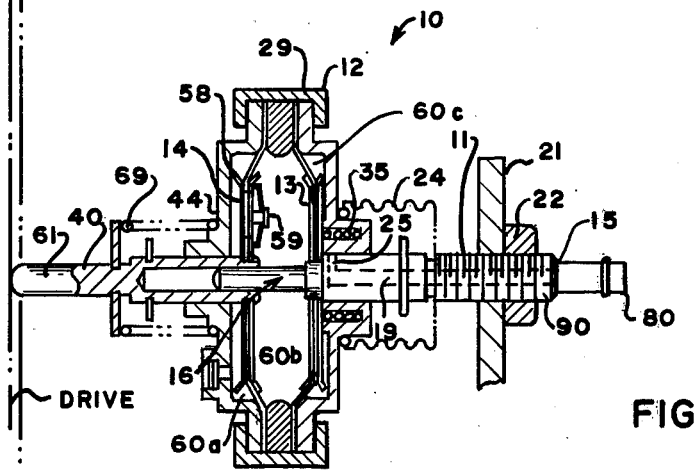
FIG. 3 is a sectional view in side elevation, partly broken away illustrating the run position of the device shown in FIG. 1.

Activation of the linkage 7 by the operator of a motor vehicle having an internal combustion engine as the drive source, for example, causes the linkage 7 to move away from abutment with the shaft 40. The shaft 40, consequently, extends to the position shown in FIG. 3 as the spring 69 drives the diaphragm assembly 14 leftwardly, leftwardly being referenced to FIG. 3.

When the linkage 7 again engages the end 61 of the shaft 40 to drive the diaphragm assembly 14 rightwardly, the air in the chamber 60*b* is compressed, and retards movement of the diaphragm assembly 14. The leakage means 59 permits the diaphragm assembly 14 to move rightwardly at a controlled rate, rightwardly being referenced to FIG. 3, so that the throttle valve 4 closes at a slow, controlled rate from running conditions.

The diaphragm assembly 14 continues to operate in the manner during engine on times. Upon engine deactivation, vacuum is removed from the chamber portion 60*c*. The spring 35 drives the housing 12 rightwardly, bringing the shaft 40 to a position below curb idle and permitting the throttle to close below the curb idle position, thereby preventing engine after run.

Numerous variations, within the scope of the appended claims, will be apparent to those skilled in the art in light of the foregoing description and accompanying drawings. Thus, the design silhouette of the various structural compnents illustrated in the drawings may be varied. Operative designs of individual components may vary. Thus, leakage means 59 merely is illustrative of a variety of designs suitable for the purpose described. The carburetor and associated linkage is representative of the variety of such structures to which our invention is applicable. While the shaft 40 is described as having a receptacle 63 formed in an end of it, the receptacle may be formed in the dash pot stem 11 so that the shaft 40 rides in the dash pot stem 11, rather than the reversed structure described. While the connector 80 was described as a separate component, it will be recognized that the connector 80 may be constructed integrally with the dash pot stem 11, if desired. As used in this specification, carburetor control device and vacuum controlled throttle positioner and dash pot are intended to be synonymous. These variations are merely illustrative.

Having thus described the invention, what is claimed and desired to be secured by Letters Patent is:

1. A vacuum controlled throttle positioner and dash pot for regulating a carburetor of an internal combustion engine, comprising:

a dash pot stem having a first end and a second end, said dash pot stem having an axial opening extending at least partially through it, and a second opening extending radially through it, said radial opening communicating with said axial opening, said dash pot stem having a threaded portion along said first end;

a diaphragm housing movably mounted on said dash pot stem, said diaphragm housing defining a chamber;

a first diaphragm assembly including a first flexible diaphragm mounted in said chamber and dividing said chamber into a first chamber part and a second chamber part, the radial opening in said dash pot stem communicating with said first chamber part, said first flexible diaphragm being attached to said valve stem; and a second diaphragm assembly including a second flexible diaphragm movably mounted in said housing between at least a first position and a second position, said second diaphragm dividing said second chamber part into a third chamber part, a shaft mounted to said second diaphragm and movable therewith, said shaft having a first end extending through said housing and a second end having a receptacle formed in it, said receptacle being adapted to receive the second end of said dash pot stem, said second diaphragm assembly being movably mounted along the second end of said stem.

2. The device of claim 1 wherein said diaphragm housing comprises a first section and a second section, said first and said second sections being joined to one another along a connector portion.

3. The device of claim 2 wherein said connector portion includes a supporting ledge, said first and second flexible diaphragms having peripheral edges interleaved between said first and said second sections of said housing and said supporting ledge.

4. The device of claim 3 wherin said second diaphragm assembly is further characterized by leakage means for permitting the equalization of pressure on opposite sides of said second diaphragm.

5. The device of claim 4 wherein said second section of said housing has an opening in it for venting said third chamber portion to the atmosphere, and filter means associated with said opening for purifying the air entering said third chamber portion.

6. The device of claim 5 wherein the second section of said housing includes a central hub, said hub having a central opening in it permitting passage of said shaft, said shaft having a spring stop mounted to it, and a spring biased between said spring stop and the second section of said housing.

7. The device of claim 6 wherein said first section of said housing includes a central hub, said hub defining a recess on the chamber side of said first section, and a spring mounted in said recess and biased between said first section and said first diaphragm assembly.

8. In a control device for an internal combustion engine, said engine having a carburetor including a throttle, and linkage means operatively connected to the throttle of said carburetor, the improvement which comprises integral diaphragm actuated means for controlling the time required to return to a curb idle setting from a run position of said carburetor, and for permitting the throttle of said carburetor to close below its curb idle setting upon deactivation of said internal combustion engine, said diaphragm actuated means comprising a dash pot stem, said dash pot stem having an axial opening in it and a radial opening through it, said radial opening communicating with said axial opening, a diaphragm housing movably mounted on said valve stem, said housing defining a chamber, a first diaphragm assembly including a first flexible diaphragm mounted in said housing, said first flexible diaphragm dividing said chamber into a first chamber part and a second chamber part, the radial opening of said shaft communicating with said first chamber part, a second diaphragm assembly including a second flexible diaphragm movably mounted in said housing between a first position and a second position, said second diaphragm dividing said second chamber part into a third chamber part, a shaft mounted for movement with said second diaphragm and extending through said housing, said shaft and said dash pot stem being interconnectable with one another so that said second diaphragm assembly is movable along the second end of said valve stem.

9. The improvement of claim 8 wherein said diaphragm housing comprises a first section, a second section, and a connector portion, said connector portion joining said first and said second sections to define said housing.

10. The improvement of claim 9 wherein said diaphragm housing comprises a first section and a second section, said first and said second sections being joined to one another along a connector portion.

11. The improvement of claim 10 wherein said connector portion includes a supporting ledge, said first and second flexible diaphragms having peripheral edges interleaved between said first and said second sections of said housing and said supporting ledge.

12. The improvement of claim 11 wherein said second diaphragm assembly is further characterized by leakage means for permitting the equalization of pressure on opposite sides of said second diaphragm.

13. The improvement of claim 12 wherein said second section of said housing has an opening in it for venting said third chamber portion to the atmosphere, and filter means associated with said opening for purifying air entering said third chamber portion.

14. An integral vacuum controlled throttle positioner and dash pot device for regulating a carburetor of an internal combustion engine, comprising:

a dash pot stem having a first end and a second end, said valve stem having a passage through it, said passage being operatively connected to a source of engine vacuum on one end thereof;

a diaphragm housing movably mounted on said dash pot stem, said diaphragm housing defining a chamber;

a first diaphragm assembly including a first flexible diaphragm mounted in said chamber and dividing said chamber into a first chamber part and a second chamber part, said first chamber part communicating with the passage in said dash pot stem, and biasing means operatively connected between said first diaphragm and said housing on the first chamber part side of said first diaphragm assembly, said first diaphragm assembly being attached to said valve stem;

a second diaphragm assembly including a second flexible diaphragm mounted in the second chamber part of said housing and being movable between at least a first position and a second position, a shaft attached to and movable with said second diaphragm, said shaft having a first end extending through said housing and a second end, the second end of said shaft and the second end of said dash pot stem being interconnected so as to permit movement of said shaft along said dash pot stem, and biasing means operatively connected between said housing and said second diaphragm assembly, said biasing means adapted to exert a force on said second diaphragm assembly tending to drive said second diaphragm toward one of its first and second positions.

15. The device of claim 14 wherein said diaphragm housing comprises a first section and a second section, said first and said second sections being joined to one another along a connector portion.

16. The device of claim 15 wherein said connector portion includes a supporting ledge, said first and second flexible diaphragms having peripheral edges interleaved between said first and said second sections of said housing and said supporting ledge.

* * * * *